US011264758B2

(12) United States Patent
Ingham

(10) Patent No.: US 11,264,758 B2
(45) Date of Patent: Mar. 1, 2022

(54) HOLDER BRACKET FOR EXTENSION CORD RECEPTACLE HEAD

(71) Applicant: Bradley S. Ingham, Brazoria, TX (US)

(72) Inventor: Bradley S. Ingham, Brazoria, TX (US)

( * ) Notice: Subject to any disclaimer, the term of this patent is extended or adjusted under 35 U.S.C. 154(b) by 0 days.

(21) Appl. No.: 17/008,003

(22) Filed: Aug. 31, 2020

(65) Prior Publication Data

US 2021/0104838 A1 Apr. 8, 2021

Related U.S. Application Data

(60) Provisional application No. 62/912,111, filed on Oct. 8, 2019.

(51) Int. Cl.
*H01R 13/627* (2006.01)
*H01R 13/73* (2006.01)

(52) U.S. Cl.
CPC ..... *H01R 13/627* (2013.01); *H01R 13/73* (2013.01)

(58) Field of Classification Search
None
See application file for complete search history.

(56) References Cited

U.S. PATENT DOCUMENTS 2,138,735 A 11/1938 Ellis
2,721,717 A 10/1955 Wales
3,019,357 A 1/1962 Zaffina
3,049,688 A 8/1962 Sinopoli
3,325,639 A 6/1967 King
3,520,988 A 7/1970 Ballock, Sr.
3,553,627 A 1/1971 Gerber
3,811,104 A * 5/1974 Caldwell ..... H01R 13/6395 439/135
4,467,263 A 8/1984 Conforti et al.
4,662,697 A * 5/1987 Moses ..... H01R 13/6395 174/67
4,690,476 A 9/1987 Morganrath
4,752,054 A 6/1988 Jonsson
4,772,220 A 11/1988 Hallier, Jr.
4,940,423 A * 7/1990 Aihara ..... H01R 13/639 439/345
5,056,677 A 10/1991 Toyosawa
5,141,192 A 8/1992 Adams
5,179,555 A 1/1993 Kilpatrick et al.
5,308,253 A 5/1994 Maki
(Continued)

OTHER PUBLICATIONS

E-Hazard; "Electric Safety: 4 Common Mistakes Using Extension Cords", retrieve on Oct. 29, 2021 from https://e-hazard.com.
(Continued)

*Primary Examiner* — Oscar C Jimenez
(74) *Attorney, Agent, or Firm* — Robert H. Frantz

(57) ABSTRACT

A holder bracket for extension cord receptacle head having a base plate and one or more clips, hooks, claws, or latches for receiving and securing to a surface a receptacle head of an electrical extension cord. The clips, hooks, claws, or latches provide flexibility which allow for easy intentional insertion and removal of the receptacle head of the electrical extension cord, sufficient retention force to allow single-handed plugging and unplugging of electrical plugs into and out of the receptacle head, and a forceful release feature to prevent or reduce trip hazards that may be posed by the electrical extension cord.

11 Claims, 6 Drawing Sheets

(56) References Cited

U.S. PATENT DOCUMENTS

| | | | | |
|---|---|---|---|---|
| 5,416,839 | A | 5/1995 | Lee | |
| D390,535 | S | 2/1998 | Mederios | |
| 5,885,098 | A * | 3/1999 | Witkowski | H01R 13/6275 439/369 |
| 6,024,606 | A * | 2/2000 | Morikawa | H01R 13/6592 439/607.45 |
| 6,080,004 | A * | 6/2000 | Kovacik | H01R 13/6392 439/352 |
| 6,210,213 | B1 | 4/2001 | Stekelenburg | |
| 6,554,621 | B1 | 4/2003 | Margalit et al. | |
| 7,688,563 | B2 | 3/2010 | O'Rourke | |
| 7,744,409 | B2 | 6/2010 | O'Rourke | |
| 7,905,736 | B2 | 3/2011 | O'Rourke | |
| 7,976,331 | B1 * | 7/2011 | Yang | H01R 13/6392 439/369 |
| 8,029,307 | B2 | 10/2011 | O'Rourke | |
| 8,747,129 | B2 | 6/2014 | Ichio | |
| 8,752,877 | B2 | 6/2014 | Spindler et al. | |
| 8,834,198 | B2 | 11/2014 | O'Rourke | |
| 9,124,032 | B2 | 11/2015 | Arakelian | |
| 9,450,348 | B2 | 11/2016 | O'Rourke | |
| 10,361,544 | B2 | 7/2019 | Schulte | |
| 2009/0209116 | A1 * | 8/2009 | Lopez | H01R 13/6215 439/76.2 |
| 2013/0109222 | A1 * | 5/2013 | Chang | H01R 13/6395 439/359 |
| 2017/0317447 | A1 * | 11/2017 | Chen | H01R 13/6205 |
| 2021/0044063 | A1 * | 2/2021 | Inose | H01R 31/065 |

OTHER PUBLICATIONS

Harbor Freight; "Vanguard 12 Ft. × 16 Gauge Indoor Extension Cord", retrieved on Oct. 29, 2021 from https://www.harborfreight.com.

NEMA; "NEMA Connectors", retrieved on Oct. 28, 2021 from https://www.iqsdirectory.com.

OSHA; "Standard Interpretations / Use of flexible cords and cables for wiring in permanent or temporary installations", retrieved on Oct. 29, 2021 from https://www.osha.gov.

Koffler; "Extension Cord Plug Protector—#A581", retrieved on Sep. 24, 2019, from https://www.kofflersales.com.

* cited by examiner

HOLDER BRACKET FOR EXTENSION CORD RECEPTACLE HEAD

This patent application claims benefit of the filing date of U.S. Provisional Patent Application 62/912,111, filed on Oct. 8, 2019, by Bradley S. Ingham. The invention generally relates technologies to provide convenient positioning of a receptacle end of an electrical extension cord.

BACKGROUND OF INVENTION

Field of the Invention

In-wall electrical receptacles are often hidden by furniture in a residential or office setting, and are not conveniently located for frequent plugging in and unplugging of mobile computer power cords, low-voltage chargers for mobile devices, and the like. Modern mobile devices and portable devices often do not provide more than 2 or 3 feet of wire, which further complicates plugging their charging cords directly into a wall receptacle and using the devices in a lap, on a table top or at a desk. Reaching these out-of-reach receptacles to plug in or unplug cords can be difficult, dangerous, and sometimes can lead to injury.

SUMMARY DISCLOSURE OF THE INVENTION

A holder bracket for extension cord receptacle head is disclosed having a base plate and one or more clips, hooks, claws, or latches for receiving and securing to a surface a receptacle head of an electrical extension cord. The clips, hooks, claws, or latches provide flexibility which allow for easy intentional insertion and removal of the receptacle head of the electrical extension cord, sufficient retention force to allow single-handed plugging and unplugging of electrical plugs into and out of the receptacle head, and a forceful release feature to prevent or reduce trip hazards that may be posed by the electrical extension cord.

BRIEF DESCRIPTION OF THE DRAWINGS

The description set forth herein is illustrated by the several drawings, which are not necessarily drawn to mechanical scale.

DETAILED DESCRIPTION OF EMBODIMENT(S) OF THE INVENTION

The inventor of the present invention has recognized a problem in the art not previously recognized or addressed related to convenient use of electrical extension cords, which are also sometimes referred to as power extenders, drop cords, or extension leads. Many people will plug an extension cord into a hard-to-reach wall receptacle and drape the extension cord so that its receptacle head is in an easier-to-reach location. This draping of the extension cord may route it under furniture, rugs and tables before the receptacle head is in a more easily accessible location.

Because these extension cord receptacle heads are loose and unsecured, a user must use two hands to plug and unplug a low-voltage charging block, an appliance power cord, a tool power cord, or a computer power cord. Some users will attempt to do this with just one hand, which can lead to dangerous situations during which a plug is partially inserted into a receptacle exposing a large enough gap between electrically-charged metal contacts, prongs or blades for a user's finger to potentially contact.

The present inventor surveyed a variety of extension cord receptacle heads and found the widths and depths of the common ungrounded (two-prong) type to be very similar, although not identical. There does not seem to be a national or international standard regarding the actual physical (mechanical) exterior dimensions of these extension cord receptacle heads, only for the receptacles themselves. So, the present inventor has designed, experimented with, revised, and developed a novel bracket which can be secured to a wall, floor, desk top, table top, furniture leg, or other relatively heavy and immobile fixture which receives and temporarily (non-permanently) holds the extension cord receptacle head of an electrical extension cord. Local and national building codes may prohibit permanently installing an extension cord through a wall, so this bracket is designed to comply with this non-permanent attachment requirement. Further, since these extension cords are often routed along a floor, attachment using the innovative bracket provides for a break-away feature in which someone hooking a foot in the cord will cause the extension cord receptacle head to be released from the bracket to reduce tripping hazards.

Figure 1:
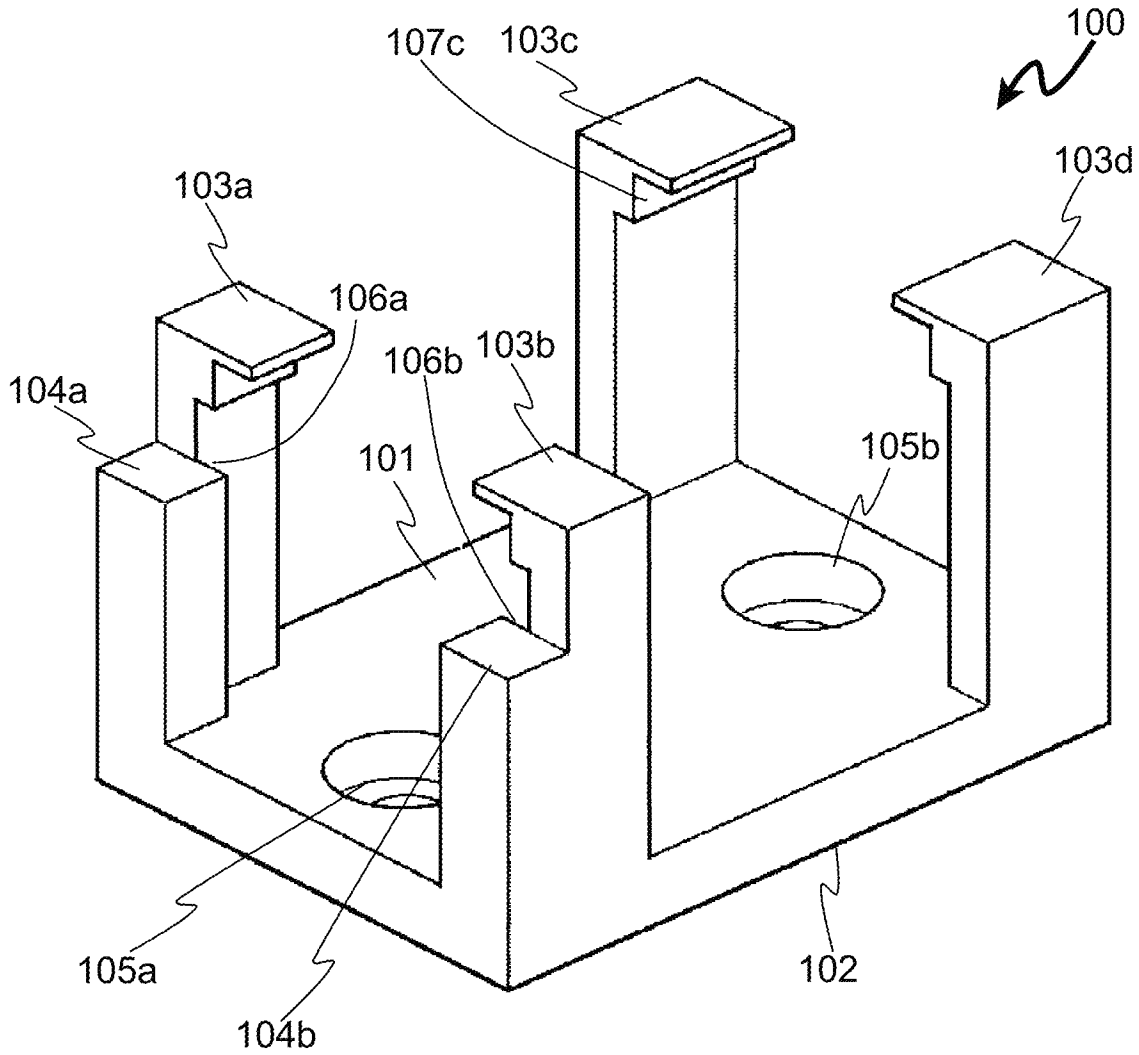
FIG. 1 shows an isometric view of an exemplary holder bracket for extension cord receptacle head, according to the present invention.

Turning to FIG. 1, an isometric view of such holder bracket 100 for extension cord receptacle head is shown. This exemplary embodiment has a generally rectangularly-shaped base plate with a back surface 102 for contacting a mounting surface, and a top or front surface 101 juxtaposed to the back surface 102 for forming at least one boundary of a channel to receive an electrical extension cord receptacle head. This exemplary embodiment has two counter-sunk holes 105*a* and 105*b* for receiving screws or other fasteners to mount the base plate to a relatively heavier and less mobile surface, such as a wall, table leg, desk top, etc. Other means of affixing may be suitable in other embodiments, such as double-sided foam adhesive tape, hook-and-loop fasteners, staples, nails, tie wraps, and glue.

This exemplary embodiment has four retention pillars 103*a*, 103*b*, 103*c* and 103*d*, each of which has an inward-facing hook, latch or claw portion facing towards a channel formed between the upper base plate surface 101 and the pillars. In other embodiments, more or less pillars may be employed, as well as walls and guides. In this exemplary embodiment, the pillars and base plate are of unitary fabrication using 3D printing, injection molding, casting, or subtractive manufacturing techniques, using a plastic or other flexible and resilient, electrically non-conductive material, such as polyvinyl chloride (PVC). in at least one embodiment, the dimensions of the pillars and the material employed to form the pillars provide for bending or flexing outwardly from the channel in order to receive larger extension cord receptacle heads, and in order to provide a release feature above a certain force of pull on the electrical extension cord.

The exemplary embodiment of the bracket 100 further includes two detents 104*a*, 104*b*, positioned towards and exit end of the channel, such as near the two pillars 103*a* and 103*b*, as shown. These provide for a substantial narrowing of the channel so that, as the electrical extension cord receptacle head is received into the opposite entry end of the channel and the cord is passed between the detents, the electrical extension cord receptacle head can be moved into the channel by pulling lightly on the cord until the electrical extension cord receptacle head reaches and comes into mechanical interference with surfaces 106*a* and 106*b* of the detents 104*a* and 104*b*. If the spacing between the opposing pairs of pillars is near or slightly less than the width of the received electrical extension cord receptacle head, the electrical extension cord receptacle head will now be held into the bracket, and thus non-permanently secured to the affixed surface, via a friction fit. When the dimensions and material selections in certain embodiments provide that a force required to spread the pillars and hooks for the release feature is more than the a force required to insert (plug in) or remove (unplug) an electrical plug from the receptacle head, then single-handed manipulation is successfully provided in those certain embodiments.

Figure 2:
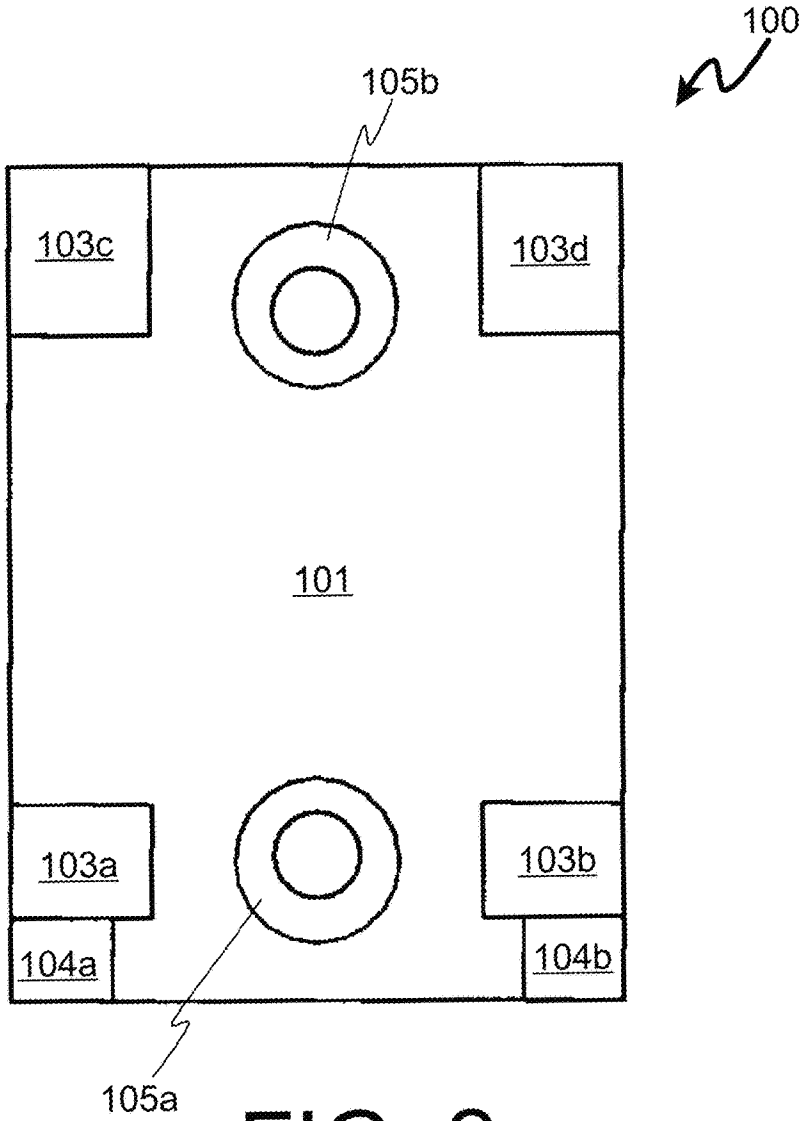
FIG. 2 depicts a top-down view of the exemplary bracket embodiment of FIG. 1.
Figure 3:
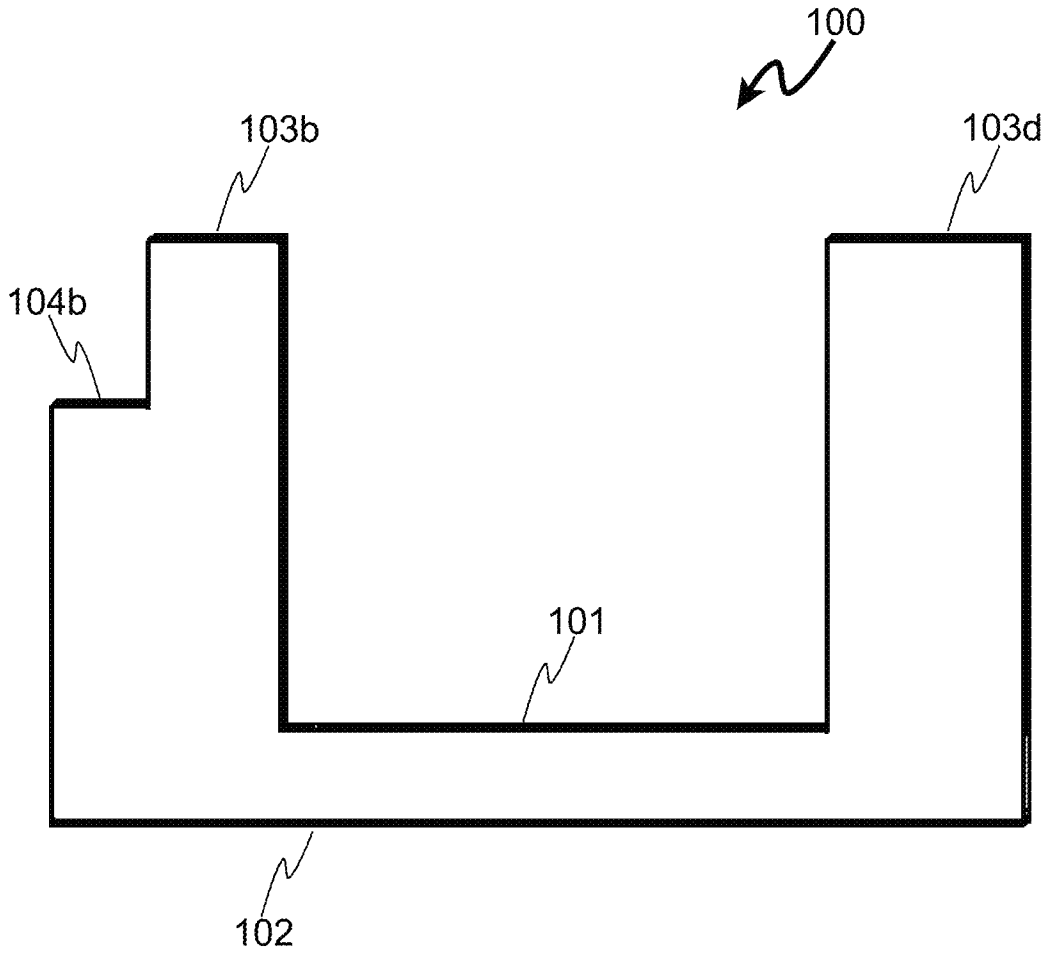
FIG. 3 illustrates a side view corresponding to the exemplary embodiment of FIG. 1.
Figure 4:
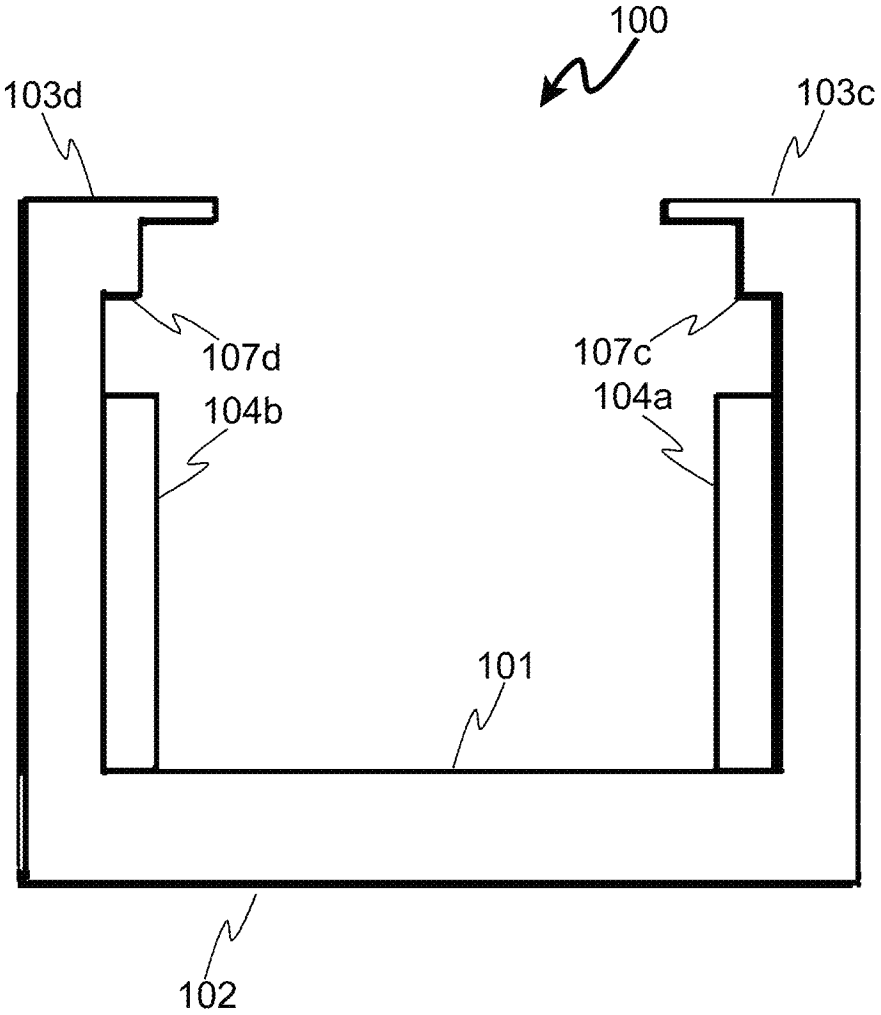
FIG. 4 provides a view from the channel entry end of the exemplary embodiment of FIG. 1.
Figure 5:
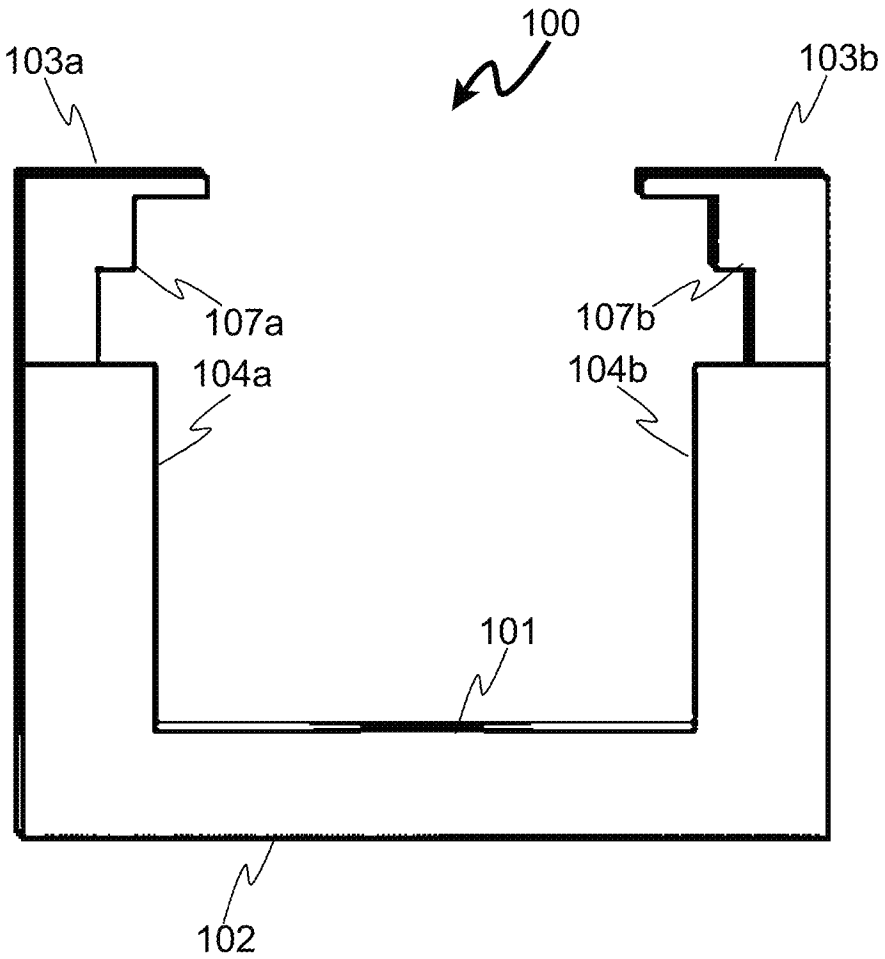
FIG. 5 shows a view from a channel exit end of the exemplary embodiment of FIG. 1.
Figure 6:
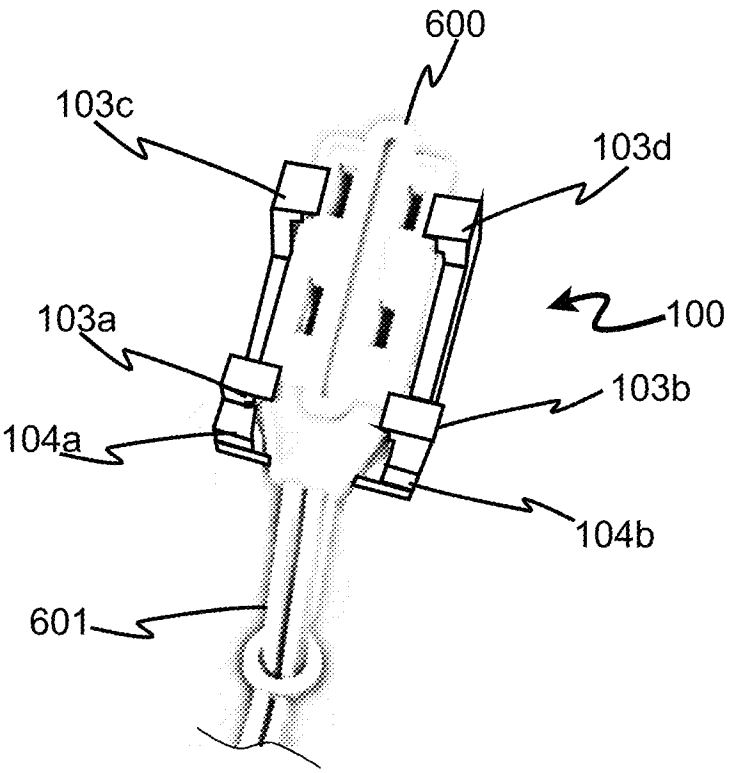
FIG. 6 shows a configuration of the exemplary embodiment of the bracket with an electrical extension cord receptacle head retained in it.

Referring now to FIG. 2, top-down view taken orthogonally to top surface 101 is illustrated for the exemplary embodiment of FIG. 1. FIG. 3 provides a corresponding side view of the exemplary embodiment, and FIG. 4 provides a view from the channel entry end of the exemplary embodiment. FIG. 4 illustrates the narrowing of the channel formed by the detents 104*a* and 104*b*. FIG. 5 provides a view from the channel exit end of the exemplary embodiment. FIG. 6 shows a configuration of the bracket 100 in which a receptacle head 600 of an electrical extension cord 601 has been received and retained.

It should be noted that, in some embodiments, one or more of the pillars may be provided with a secondary shoulder or protrusion 107*a*, 107*b*, 107*c*, and 107*d*, which can provide for a closer friction fit for electrical extension cord receptacle heads which are thinner than others or which have more pronounced radius corners around the heads.

Conclusion. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

It will be readily recognized by those skilled in the art that the foregoing example embodiment(s) do not define the extent or scope of the present invention, but instead are provided as illustrations of how to make and use at least one embodiment of the invention. The following claims define the extent and scope of at least one invention disclosed herein.

I claim:

1. A bracket for non-permanently holding a receptacle head of an electrical power extension cord to a wall, floor, desk top, table top, furniture leg, or other heavy or immobile fixture, wherein the receptacle head is of a generally rectangular parallelepiped shape with at least one electrical receptacle socket on a substantially planar socket face which is parallel to an opposite rear surface, the bracket comprising:

a rectangularly-shaped base plate having a bottom back surface for contacting a mounting surface, having a left edge and a right edge, and a front surface juxtaposed to the back surface;

at least a first retention pillar disposed on a bottom end on the left edge of the base plate and extending orthogonally upwards from the base plate front surface;

at least a second retention pillar disposed on a bottom end on the right edge of the base plate and extending orthogonally upwards from the base plate front surface, thereby defining, with the first retention pillar, a three-sided channel between the front surface, the first retention pillar and the second retention pillar configured to receive the receptacle head such the at least one electrical receptacle socket is accessible between the first and second retention pillars for plugging in and unplugging a power plug;

at least a first head retention portion disposed on a top end of the first retention pillar extending towards a center of the three-sided channel and configured to engage the socket face of the receptacle head;

at least a second head retention portion disposed on a top end of the second retention pillar extending towards the center of the three-sided channel and configured to engage the socket face of the receptacle head, such that force of an unplugging action is absorbed by the at least first head retention portion and by the at least second head retention portion via the retention pillars, thereby retaining the receptacle head in the bracket for single-handed unplugging action; and one or more detentes positioned at a cord exit end of the three-sided channel narrowing the channel to prevent the receptacle head from exiting via the cord exit end.

2. The bracket as set forth in claim 1 wherein the one or more of the retention pillars comprises one or more side portions.

3. The bracket as set forth in claim 2 wherein the one or more side portions comprises at least a wall.

4. The bracket as set forth in claim 2 wherein the one or more side portions comprises at least a channel guide.

5. The bracket as set forth in claim 2 wherein the one or more side portions is configured to flex to hold the extension cord receptacle head.

6. The bracket as set forth in claim 1 further comprising one or more shoulder protrusions disposed under at least one head retention portion which slightly narrows the three-sided channel, thereby providing a closer fit for electrical extension cord receptacle heads which are thinner than other electrical extension cord receptacle heads or for electrical extension cord receptacle heads which have more pronounced radius corners than other electrical extension cord receptacle heads.

7. The bracket as set forth in claim 1 wherein the at least one at first retention pillar and the at least one second retention pillar is configured to provide a friction fit to hold the extension cord receptacle head.

8. The bracket as set forth in claim 1 wherein the at least one first head retention portion or the at least one second head retention portion comprises a hook.

9. The bracket as set forth in claim 1 wherein the at least one first head retention portion or the at least one second head retention portion a latch.

10. The bracket as set forth in claim 1 wherein the at least one first head retention portion or the at least one second head retention portion comprises a claw.

11. The bracket as set forth in claim 1 wherein the at least one at first retention pillar, the at least one second retention pillar, the at least one first head retention portion, and the at least one second head retention portion are configured to release the extension cord receptacle head upon a predetermined amount of force applied to the extension cord which exceeds the amount of force the unplugging action.

* * * * *